US009526134B2

(12) United States Patent
Kim et al.

(10) Patent No.: US 9,526,134 B2
(45) Date of Patent: Dec. 20, 2016

(54) ILLUMINATION MODULE

(71) Applicant: LG INNOTEK CO., LTD., Seoul (KR)

(72) Inventors: Keun Young Kim, Seoul (KR); Hyun Sung Kang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/781,201

(22) PCT Filed: Mar. 28, 2014

(86) PCT No.: PCT/KR2014/002682

§ 371 (c)(1),
(2) Date: Sep. 29, 2015

(87) PCT Pub. No.: WO2014/157997

PCT Pub. Date: Oct. 2, 2014

(65) Prior Publication Data

US 2016/0057821 A1 Feb. 25, 2016

(30) Foreign Application Priority Data

Mar. 29, 2013 (KR) ..... 10-2013-0034896

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 33/08*** | (2006.01) |

(52) U.S. Cl.

CPC ..... *H05B 33/0809* (2013.01)

(58) Field of Classification Search

None

See application file for complete search history.

(56) References Cited

U.S. PATENT DOCUMENTS

| | | | | |
|---|---|---|---|---|
| 6,181,085 | B1 | 1/2001 | Nilssen | |
| 2008/0197786 | A1* | 8/2008 | Schaible | H05B 33/0815 315/224 |
| 2011/0043127 | A1* | 2/2011 | Yamasaki | H05B 33/0809 315/291 |
| 2012/0161666 | A1 | 6/2012 | Antony et al. | |
| 2012/0313540 | A1* | 12/2012 | Lin | F21V 23/003 315/201 |

FOREIGN PATENT DOCUMENTS

| | | | |
|---|---|---|---|
| KR | 10-0915892 | B1 | 9/2009 |
| KR | 10-2011-0062243 | A | 6/2011 |
| KR | 10-2011-0102285 | A | 9/2011 |
| KR | 10-1144629 | B1 | 5/2012 |
| KR | 10-2012-0071365 | A | 7/2012 |

OTHER PUBLICATIONS

International Search Report in International Application No. PCT/KR2014/002682 filed Mar. 28, 2014.

* cited by examiner

*Primary Examiner* — Anh Tran

(74) *Attorney, Agent, or Firm* — Saliwanchik, Lloyd & Eisenschenk

(57) ABSTRACT

A lighting module includes a compatible part to transform and output an output voltage from a ballast, a transformation part to transform and output an output voltage from the compatible part, and a lighting part to emit light using an output voltage from the transformation part as a driving voltage. In the compatible part, a number of ports to receive the output voltage from the ballast is different form a number of ports to output the transformed output voltage to the transformation part.

5 Claims, 4 Drawing Sheets

ILLUMINATION MODULE

CROSS-REFERENCE TO RELATED APPLICATIONS

This application is the U.S. national stage application of International Patent Application No. PCT/KR2014/002682, filed Mar. 28, 2014, which claims priority to Korean Application Nos. 10-2013-0034896, filed Mar. 29, 2013, the disclosures of each of which are incorporated herein by reference in their entirety.

TECHNICAL FIELD

The present invention relates to a lighting module.

BACKGROUND ART

A light emitting diode (LED) is eco-friendly. In addition, since the LED has a response speed of several nano-seconds to respond at a high speed, the LED is effective in a video signal stream.

In addition, the LED allows impulsive driving, and has more than 100% of color reproducibility. In addition, brightness and a color temperature may be arbitrarily changed by adjusting the quality of light of a red, green, or blue LED.

In addition, the LED, which is an eco-friendly light source having no mercury differently from other light sources, has been spotlighted as a next-generation light source used in a backlight unit (BLU) for a portable phone, a BLU for an LCD TV, a lamp for a vehicle, and a typical lamp.

Accordingly, an incandescent light used as a main light source for lighting and having a low-power efficiency characteristic or a fluorescent light having an environmental waste such as mercury has been substituted with the LED lamp.

A lamp of a type similar to the fluorescent light uses a ballast (electric transformer). When the lamp is substituted with the LED lamp, a conventional ballast is used for the LED lamp without change.

In the case of the LED lamp using the ballast (electric transformer) similarly to the conventional circuit configuration, the output voltage of the ballast becomes input voltage of a power supply unit (PSU) of the LED lamp without change.

Accordingly, the compatibility between the ballast and the PSU may be varied depending on the manufactures of the ballast and the LED lamp, thereby causing the erroneous operation of the LED lamp or the ballast.

Accordingly, the compatibility between the PSU including a switching mode power supply of the LED lamp and the ballast is important.

In particular, since the ballast is configured in the structure of an inverter, the ballast outputs a significantly swift waveform. In the case of a conventional PSU using the output as input voltage after rectifying the output, the compatibility with the output from the ballast may be lowered.

In addition, the operating voltage of the PSU of the LED lamp is insufficient, so that the PSU may be erroneously operated. When the PSU is erroneously operated, phenomenon such as flicker and noise may occur.

DISCLOSURE

Technical Problem

The embodiment provides a power supply device capable of preventing the flicker phenomenon and of being stably compatible with a ballast.

Technical Solution

According to the embodiment, there is provided a lighting module including a compatible part to transform and output an output voltage from a ballast, a transformation part to transform and output an output voltage from the compatible part, and a lighting part to emit light using an output voltage from the transformation part as a driving voltage. In the compatible part, the number of ports to receive the output voltage from the ballast is different form the number of ports to output the transformed output voltage to the transformation part.

The compatible part receives the output voltage from the ballast through four ports, and outputs the transformed output voltage to the transformation part through two ports.

The ballast filters AC voltage and outputs the AC voltage through four ports. The compatible part includes a compatible unit to output to two output nodes by connecting two ports of the four ports of the ballast with each other, and a preprocessing part to rectify voltages at two output nodes of the compatible unit.

In addition, the compatible unit includes first and second diodes to connect first and second ports of the ballast with a first output node, and third and fourth diodes to connect third and fourth ports of the ballast with a second output node.

In addition, the first and second diodes are connected in reverse to each other based on the first output node, and the third and fourth diodes are connected in reverse to each other based on the second output node.

In addition, the preprocessing part includes a bridge diode formed at the first and second output nodes.

Further, the preprocessing part includes fifth and sixth nodes to connect the first output node with third and fourth output nodes, respectively, and first and second capacitors connected between the second output node and the third output node and between the second output node and the fifth output node, respectively In addition, the fifth and sixth diodes are connected in reverse to each other based on the first output node.

Further, the preprocessing part includes a booster to boost the output voltage from the compatible unit to at least three times voltage.

In addition, the compatible unit includes a first inductor formed between the first and second ports to short the first and second ports at the first output node, and a second inductor formed between the third and fourth ports to short the third and fourth ports at the second node.

Advantageous Effects

As described above, according to the present invention, when an auxiliary booster to support the ballast is additionally provided, the compatibility between the output voltage from the ballast and the operation of the LED lamp can be improved. In addition, an erroneous operation, which is caused by an insufficient operating voltage of the power supply unit occurring as the output voltage of the ballast is lowered, can be prevented. Further, due to the characteristic of the structure of the auxiliary booster to support the ballast, an AC input is converted into a DC output, so that the conventional rectifier can be omitted.

In addition, the auxiliary booster to support the ballast can be configured to boost voltage to two times, three times, or more, so that an application can be variously achieved depending on the setting of the output LED load. Further, if the compatibility in operation between the ballast and the LED lamp is increased using the auxiliary booster to support the ballast, the flicker and the noise can be prevented.

BEST MODE

Mode for Invention

Hereinafter, embodiments of the present invention will be described in detail with reference to accompanying drawings so that those skilled in the art can easily work with the embodiments. However, the present invention may have various modifications, but are not limited to the embodiments.

In the following description, when a predetermined part "includes" a predetermined component, the predetermined part does not exclude other components, but may further include other components unless otherwise indicated.

The present invention provides a power supply device capable of ensuring the compatibility with a ballast.

Hereinafter, a lighting device according to the embodiment of the present invention will be described with reference to FIGS. 1 and 2.

Figure 1:
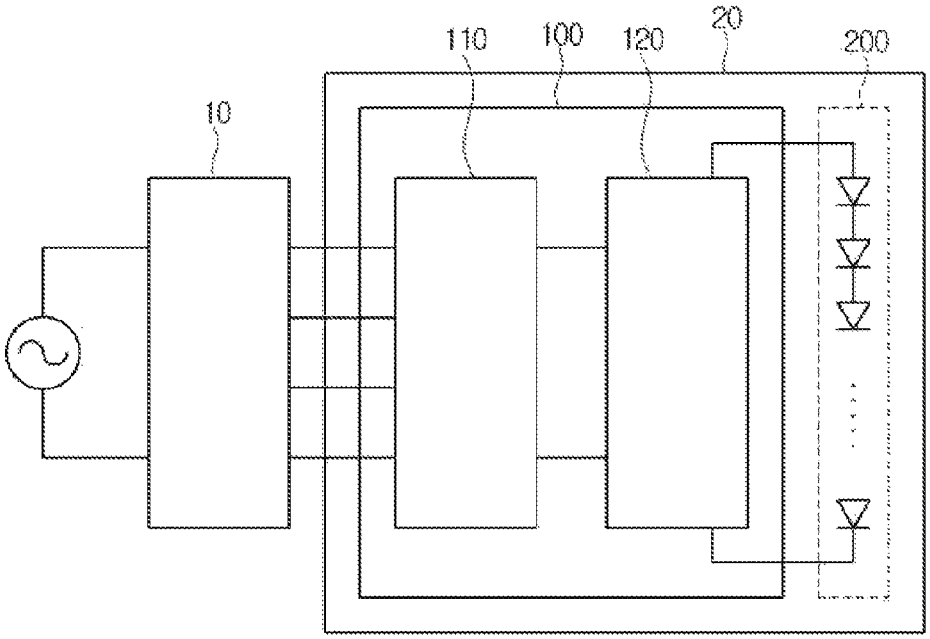
FIG. 1 is a block diagram showing a lighting device including a power supply device according to the present invention.
Figure 2:
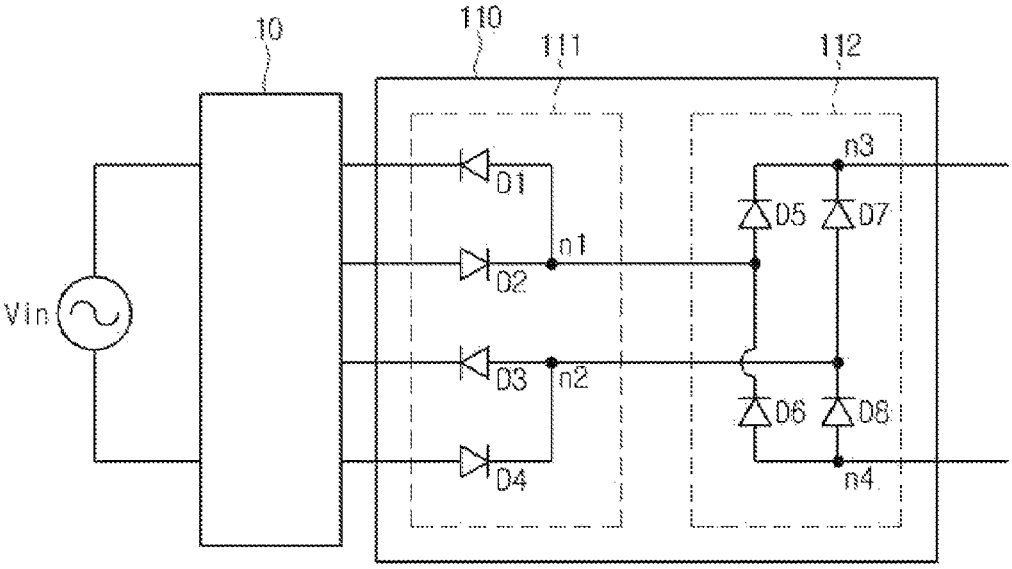
FIG. 2 is a circuit diagram showing a compatible circuit of a ballast and the power supply device of FIG. 1 according to a first embodiment.

FIG. 1 is a block diagram showing a lighting device including a power supply device according to the present invention, and FIG. 2 is a circuit diagram showing a compatible circuit of a ballast and the power supply device of FIG. 1 according to a first embodiment.

Referring to FIG. 1, the lighting device including a power supply device 100 according to the present invention may include a ballast 10 and a lighting module 20, and the lighting module 20 may include the power supply device 100 and a lighting part 200.

The ballast 10 receives supply AC voltage which is wall voltage Vin, suppresses overcurrent, and stabilizes and output the AC voltage.

The ballast 10 may be an electronic ballast or a mechanical ballast. The mechanical ballast 10 may be realized with a current filter using a transform, and the electronic ballast may be one of half bridge, instant start, program start, starter lamp, and rapid start types of ballasts.

The ballast 10 may transmit power through four ports, positive voltage may be transmitted through two of the four ports, and negative voltage may be transmitted through the other two ports. The polarity of the voltage is varied depending on frequencies.

The lighting part 200 may include a plurality of lighting emitting modules. When each lighting module includes a plurality of light emitting diodes (LEDs), the lighting part 200 may include at least one light emitting unit including a row of light emitting diodes connected with each other in series as shown in FIG. 1.

The power supply device 100 may receive the power from the ballast 10 through the four ports, control an on/off state of a switching device based on an external dimming signal, supply reference power to the lighting part 200.

The power supply device 100 may further include a wireless communication module (not shown) to receive the external dimming signal. The wireless communication module receives the control signal through a wireless communication network, converts the control signal into a base band signal, and performs decoding and demodulating to create a digital control signal.

Hereinafter, the configuration and the operation of the power supply device 100 will be described with reference to FIGS. 2 to 5.

Referring to FIG. 2, the power supply device 100 includes a compatible part 110 and a transformation part 120.

The compatible part 110 includes a compatible unit 111 to receive the input voltage Vin from the ballast 10 through four ports and to allow the input voltage Vin to be compatible with the transformation part 120, and the preprocessing part 112 to rectify or boost the compatible voltage.

The compatible unit 111 includes four diodes D1 to D4 as shown in FIG. 2.

In other words, the compatible unit 111 includes four diodes D1 to D4 so that the four ports of the ballast 10 are changed into two ports for the output. The first and second ports of the ballast 10 are connected with a first node n1 through the first and second diodes D1 and D2.

The third and fourth ports of the ballast 10 are connected with a second node n2 through the third and fourth diodes D3 and D4.

The first and second ports output voltages having the same polarity, and the third and fourth ports outputs voltage having a polarity opposite to that of the voltage of the first and second ports.

The first and second diodes D1 and D2 are connected in reverse to each other based on, and the third and fourth diodes D3 and D4 are connected in reverse to each other.

Accordingly, in the compatible unit 111, even if the polarity of voltage applied thereto through one of the first and second ports is varied or an erroneous operation occurs, normal voltage is applied thereto through the other port. Accordingly, stabilized input voltage (Vin) may be applied to the compatible unit 111.

The preprocessing part 112 may include a rectifier to receive the voltages of the first and second nodes n1 and n2, and rectify and output the voltages as shown in FIG. 2.

As shown in FIG. 2, when the preprocessing part 112 acts as a rectifier, the preprocessing part 112 includes a bridge rectifier formed as a fifth diode D5 provided between the first node n1 and the third node n3, a sixth diode D6 provided between the first node n1 and a fourth node n4, a seventh diode D7 provided between the second node n2 and a third node n3, and an eighth diode D8 provided between the second node n2 and a fourth node n4.

In order to form the bridge rectifier, the fifth and sixth diodes D5 and D6 are connected in reverse to each other based on the first node n1, and the seventh and eighth diodes D7 and D8 are connected in reverse to each other based on the second node n2.

Accordingly, the preprocessing part 112 rectifies the AC voltage from the compatible unit 111 to output positive voltage to the transformation part 120.

The transformation part 120 includes a control chip, a transformer, and a switching device to receive the rectified AC voltage from the preprocessing part 112, to compensate for a power factor based on an external control signal, and to output a switching signal.

The control chip may include an integrated circuit in which a power factor compensation circuit is realized. The control chip feedbacks a primary-side output and a secondary-side output to correct VCC voltage or to control or output the switching signal.

In other words, a controller has a configuration to start the driving of a control chip by supplying reference voltage to a VCC pin of the control chip if the rectified voltage is applied thereto, to drive the switching device according to the external control signal, and to output VCC voltage to the transformation part 120.

In this case, the switching signal has a predetermined duty ratio, and an output can be controlled by controlling the duty ratio.

The transformer includes a primary coil to receive primary voltage supplied to the control chip, and a secondary coil to transform and output the voltage of the primary coil.

The voltage transformed and output by the transformer is applied to the lighting part 200 through the filter.

When the compatible unit 111 is applied prior to the rectifier as described above, the ballast 10 and the lighting module 20 are compatible with each other using two nodes regardless of the types of the ballast 10 and the lighting module 20 coupled together, so that the compatibility is possible without noise or flicker.

Hereinafter, various embodiments will be described with reference to FIGS. 3 to 6.

Figure 3:
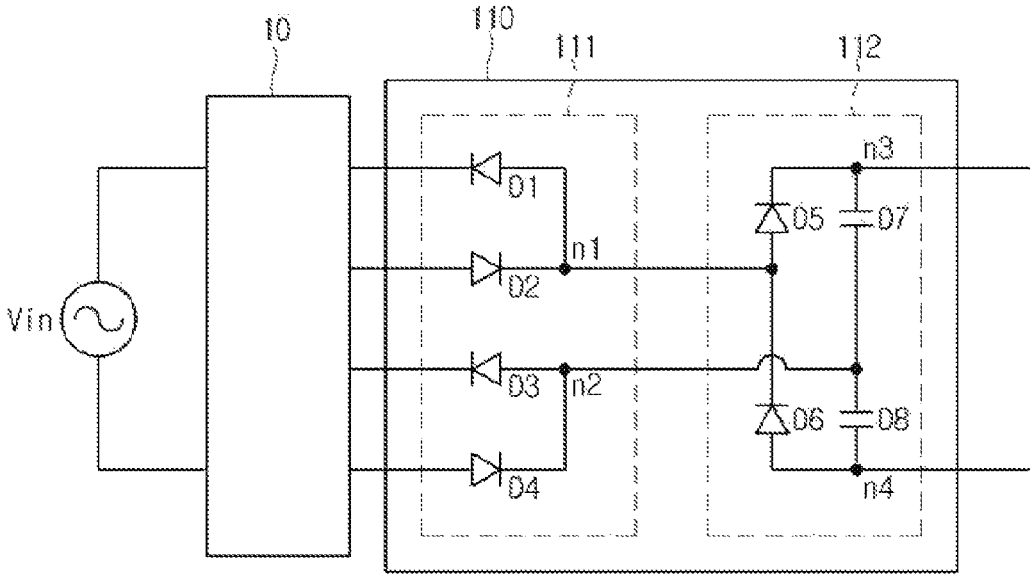
FIG. 3 is a circuit diagram showing a compatible circuit of the ballast and the power supply device of FIG. 1 according to a second embodiment.
Figure 4A:
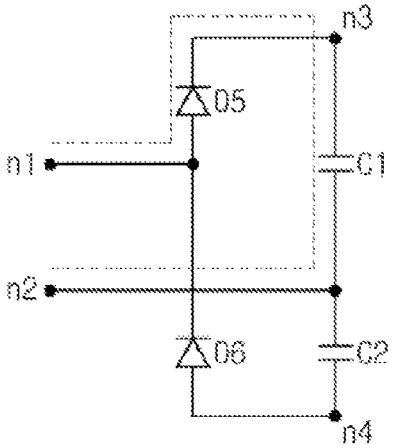
FIG. 4 is a circuit diagram showing an operation of the compatible circuit of FIG. 3.
Figure 4B:
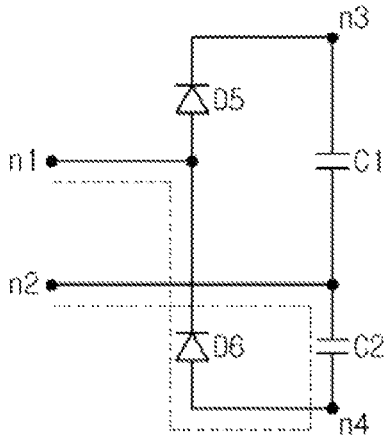

FIG. 3 is a circuit diagram showing a compatible circuit of the ballast and the power supply device of FIG. 1 according to a second embodiment, and FIG. 4 is a circuit diagram showing the operation of the compatible circuit of FIG. 3.

Referring to FIG. 3, the compatible circuit according to the second embodiment of the present invention includes a compatible unit 111 and a preprocessing part 112.

Since the compatible unit 111 is the same as that of FIG. 2, the details thereof will be omitted from the following description.

The preprocessing part 112 includes a booster including two diodes D5 and D6 and two capacitors C1 and C2 as shown in FIG. 3.

The booster may include the fifth diode D5 provided between the first node n1 and the third node n3, and the sixth diode D6 provided between the first node n1 and the fourth node n4, and the fifth and sixth diodes D5 and D6 are connected in reverse to each other.

Meanwhile, the second node n2 serves as a contact between the third and fourth nodes n3 and n4 so that the first capacitor C1 is connected with the second capacitor C2 in series.

In the preprocessing part 112, as shown in FIG. 4*a*, if positive voltage is applied to the first node n1 from the compatible unit 111, the positive voltage is charged in the first capacitor C1 through the fifth diode D5 at the first node 1.

In this case, since inverse voltage is applied to the fifth diode D5, the current does not flow, but ground voltage is set at the second node n2.

Next, if negative voltage is applied to the first node n1, the negative voltage is applied to the first capacitor C1 through the second diode D2, so that the negative voltage is charged in the second capacitor C2.

In this case, the inverse voltage is applied to the fifth diode D5, so that the fifth diode D5 has an off status.

As described above, for one period, voltage raging from the positive voltage to the negative voltage is charged in the first and second capacitors C1 and C2 between the third node n3 and the fourth node n4, so that the voltage is output with the magnitude two times greater than that of the input AC voltage.

In this case, since the output voltage passes through the capacitors C1 and C2, the output voltage may be output as DC voltage in which a portion of an AC value is removed.

Accordingly, a circuit of boosting voltage to two times voltage may be formed after the compatible unit 111, so that input voltage may be transformed to voltage having two times DC value and provided to the transformation part 120.

In this case, a resistor may be provided at a front end or a rear end of each of the capacitors C1 and C2, but the embodiment is not limited thereto.

Figure 5:
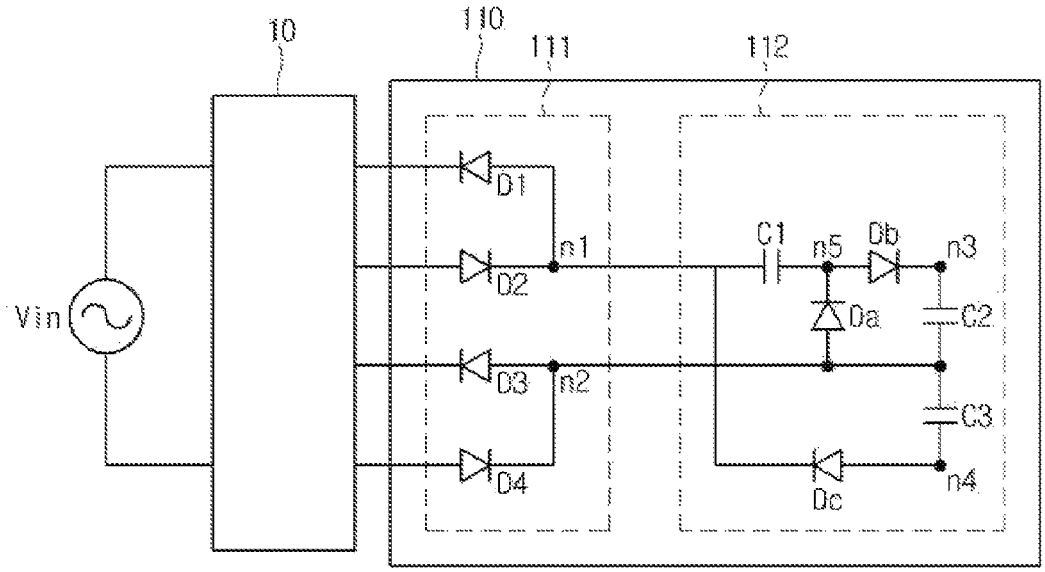
FIG. 5 is a circuit diagram showing the compatible circuit of the ballast and the power supply device of FIG. 1 according to a third embodiment.

FIG. 5 is a circuit diagram showing the compatible circuit of the ballast and the power supply device of FIG. 1 according to a third embodiment.

Since a compatible unit 111 is the same as that of FIG. 2, the details thereof will be omitted from the following description.

A preprocessing part 112 includes a booster including three diodes Da to Dc and three capacitors C1 to C3 as shown in FIG. 5.

The booster includes a fifth node n5 between the first node n1 and the third node n3.

The first capacitor C1 is provided between the first and second nodes n1 and n5, and the $a^{th}$ diode Da is connected in reverse between the fifth node n5 and the second node n2.

The $b^{th}$ diode Db is provided between the fifth node n5 and the third node n3, and the $c^{th}$ diode is provided between the first node n1 and the fourth node n4. The $b^{th}$ diode and the $c^{th}$ diode Db and Dc are connected in reverse to each other.

Meanwhile, the second node n2 serves as a contact between the third and fourth nodes n3 and n4 so that the second capacitor C2 is connected with the third capacitor C3 in series.

In the preprocessing part 112, positive voltage is charged in the first capacitor C1 if the positive voltage is applied to the first node n1 from the compatible unit 111.

Next, if negative voltage is applied to the first node n1, positive voltage from the second node n2 through the $a^{th}$ and $b^{th}$ diodes Da and Db and positive voltage of the first capacitor C1 are charged in the second capacitor C2.

In this case, the negative voltage is charged in the third capacitor C3 through the $c^{th}$ diode Dc to output voltage having a magnitude which is three times greater than that of the input Ac voltage.

In this case, since the output voltage passes through the capacitors C1 to C3, the output voltage may be output as DC voltage in which a portion of an AC value is removed.

Accordingly, a circuit of boosting voltage to three times voltage may be formed after the compatible unit 111, so that input voltage may be transformed to voltage having two times DC value and provided to the transformation part 120.

In this case, a resistor may be provided at a front end or a rear end of each of the capacitors C1 and C2, but the embodiment is not limited thereto.

Figure 6:
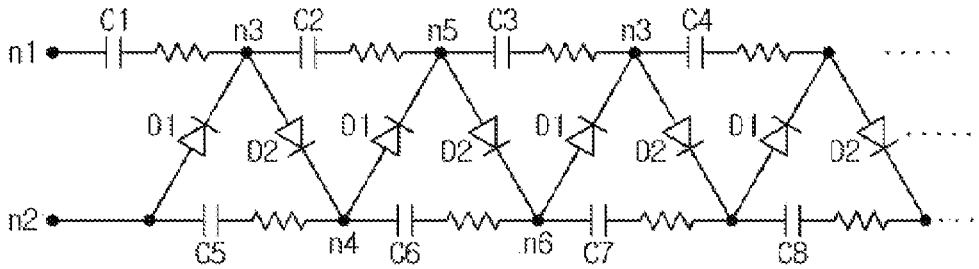
FIG. 6 is a circuit diagram showing the compatible circuit of the ballast and the power supply device of FIG. 1 according to a fourth embodiment.

FIG. 6 is a circuit diagram showing the compatible circuit of the ballast and the power supply device of FIG. 1 according to a fourth embodiment.

Since the compatible unit 111 is the same as that of FIG. 2, the details thereof will be omitted from the following description.

The preprocessing part 112 includes a booster including a plurality of diodes D1, D, . . . , and a plurality of capacitors C1, C2, . . . .

Although FIG. 6 shows only eight capacitors C1 to C8 and eight diodes D1 to D8, capacitors and diodes may be realized in series.

Capacitors may be formed between respective odd-numbered nodes n1, n3, n5, . . . , and between respective even-numbered nodes n2, n4, n6, . . . .

Diodes D1 to D8 are forwardly connected with each other in the sequential nodes n1, n2, n3, n4, . . . .

In the preprocessing part 112, positive voltage is charged in the first capacitor if the positive voltage is applied to the first node n1 from the compatible unit 111.

Next, if negative voltage is applied to the first node n1, and positive voltage is applied to the second node n2, positive voltage from the second node n2 through the first diode D1, and positive voltage of the first capacitor are charged in the second capacitor C2.

If the operations are seamlessly performed, a booster in which multiples are determined depending on the number of capacitors C1 to C8 is formed, and the voltage output through the capacitors C1 to C8 is a voltage boosted from DC voltage.

In this case, a resistor may be provided at a front end or a rear end of each of the capacitors C1 to C8, but the embodiment is not limited thereto.

The compatible unit 111 is formed as described above, and a rectifier or a booster is realized at the rear stage of the compatible unit 111, so that voltage supplied to the transformation part 120 may be variously realized. Accordingly, an application field can be enlarged.

Figure 7:
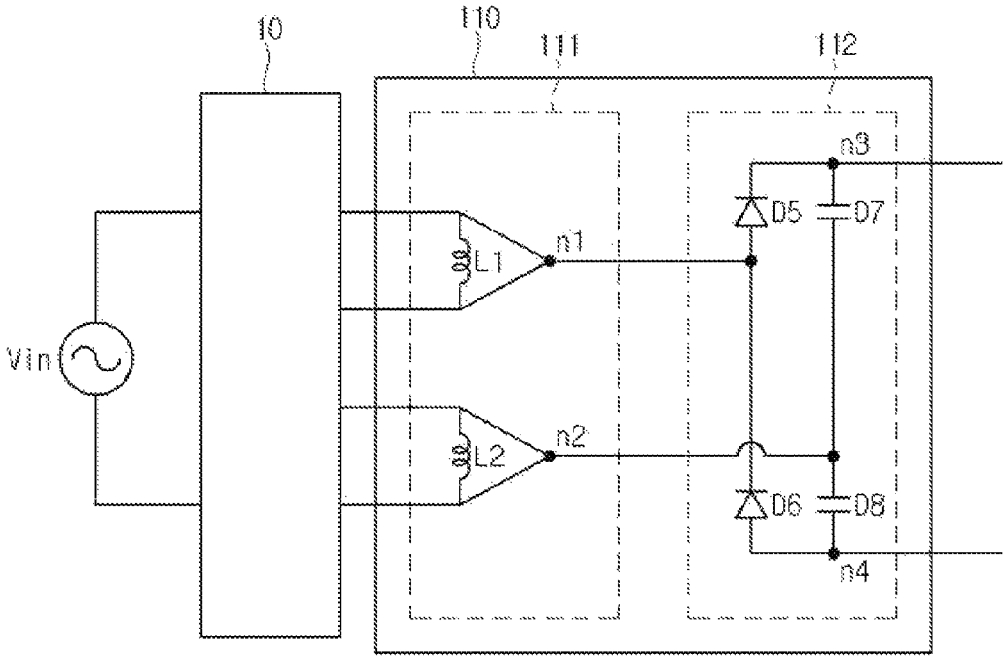
FIG. 7 is a circuit diagram showing the compatible circuit of the ballast and the power supply device of FIG. 1 according to a fifth embodiment.

FIG. 7 is a circuit diagram showing the compatible circuit of the ballast and the power supply device of FIG. 1 according to a fifth embodiment.

Referring to FIG. 7, a compatible circuit according to the fifth embodiment of the present invention includes a compatible unit 111 and a preprocessing part 112.

Since the preprocessing part 112 is the same as that of FIG. 2, the details thereof will be omitted from the following description.

The compatible unit 111 changes input voltage transmitted through four ports to voltages of two nodes n1 and n2. A first inductor L1 may be formed between the first port and the second port, and both ports may be shorted at the first node n1. A second inductor L2 may be formed between the third port and the fourth port, and both ports may be shorted at the second node n2.

Through the configuration, an output signal of the compatible unit 111 for input voltage Vin has the same waveform as that of the input voltage. If overcurrent flows, a filtered Ac waveform is output through the ballast 10.

As described above, although the embodiment of the present invention has been described in detail, the present invention is not limited thereto. Those skilled in the art can make various modification and variations of the present invention based on the basic concept defined in the accompanying claims.

The invention claimed is:

1. A lighting module comprising:

a compatible part to receive an output voltage from a ballast through first to fourth input ports, transform the received output voltage, and output the transformed output voltage through first and second output ports;

a transformation part to transform and output an output voltage from the compatible part; and a lighting part to emit light using an output voltage from the transformation part as a driving voltage, wherein the compatible part comprises:

a compatible unit to output to two output nodes by connecting two ports of the first to fourth input ports with each other; and a preprocessing part to rectify voltages at the two output nodes of the compatible unit, wherein the compatible unit comprises:

first and second diodes to connect the first and second input ports with a first output node; and third and fourth diodes to connect third and fourth input ports with a second output node, wherein the preprocessing part comprises:

fifth and sixth diodes to connect the first output node with third and fourth output nodes, respectively; and first and second capacitors connected between the second output node and the third output node and between the second output node and the fourth output node, respectively.

2. The lighting module of claim 1, wherein the first and second diodes are connected in reverse to each other based on the first output node, and the third and fourth diodes are connected in reverse to each other based on the second output node.

3. The lighting module of claim 2, wherein the preprocessing part comprises a bridge diode formed at the first and second output nodes.

4. The lighting module of claim 1, wherein the fifth and sixth diodes are connected in reverse based on the first output node.

5. The lighting module of claim 2, wherein the preprocessing part comprises a booster to boost antes output voltage from the compatible unit to at least three times voltage.

* * * * *